US011118874B2

(12) United States Patent
Huber et al.

(10) Patent No.: US 11,118,874 B2
(45) Date of Patent: Sep. 14, 2021

(54) CYLINDRICAL CASE FOR PROPELLANT CHARGE POWDER

(71) Applicant: Nitrochemie Aschau GmbH, Aschau am Inn (DE)

(72) Inventors: Alexander Huber, Grosskarolinenfeld (DE); Jens Oltmanns, Waldkraiburg (DE); Ulrich Focken, Waldkraiburg (DE); Walter Lebacher, Aschau am Inn (DE)

(73) Assignee: NITROCHEMIE ASCHAU GMBH, Aschau am Inn (DE)

( * ) Notice: Subject to any disclaimer, the term of this patent is extended or adjusted under 35 U.S.C. 154(b) by 0 days.

(21) Appl. No.: 16/593,594

(22) Filed: Oct. 4, 2019

(65) Prior Publication Data

US 2020/0116461 A1 Apr. 16, 2020

(30) Foreign Application Priority Data

Oct. 4, 2018 (DE) ..... 10 2018 007 834.6
Oct. 29, 2018 (DE) ..... 10 2018 218 423.2

(51) Int. Cl.
*F42B 5/188* (2006.01)
*F42B 5/192* (2006.01)

(52) U.S. Cl.
CPC ..... *F42B 5/188* (2013.01); *F42B 5/192* (2013.01)

(58) Field of Classification Search
CPC ..... F42B 5/188; F42B 5/192; F42B 5/181; F42B 5/18
USPC ..... 102/431, 432, 433, 464
See application file for complete search history.

(56) References Cited

U.S. PATENT DOCUMENTS

| | | | | |
|---|---|---|---|---|
| 3,218,907 A | | 11/1965 | Beal et al. | |
| 3,397,637 A | * | 8/1968 | Bobinski | F42B 5/192 102/431 |
| 3,474,702 A | | 10/1969 | Remaly et al. | |
| 3,769,873 A | | 11/1973 | Abel | |
| 5,243,914 A | | 9/1993 | Penner | |
| 6,523,476 B1 | * | 2/2003 | Riess | F42B 5/18 102/431 |
| 7,024,999 B2 | * | 4/2006 | Muskat | F42B 5/188 102/431 |
| 8,776,690 B2 | * | 7/2014 | Lebacher | F42B 5/192 102/282 |

FOREIGN PATENT DOCUMENTS

| | | |
|---|---|---|
| DE | 3008996 | 9/1981 |
| DE | 3008999 | 9/1981 |
| WO | 2011015346 | 2/2011 |

OTHER PUBLICATIONS

EPO, "Extended European Search Report," issued in Application No. EP19201561, dated Mar. 18, 2020, 5 pages.

* cited by examiner

*Primary Examiner* — John Cooper
(74) *Attorney, Agent, or Firm* — McAndrews, Held & Malloy, Ltd.

(57) ABSTRACT

The invention refers to a cylindrical sleeve (6) for receiving propellant powder (4) with a dimensionally stable jacket wall of combustible, felted fibre material and an insert (5) of a textile fabric in the jacket wall, and to a method of manufacturing a cylindrical sleeve (6).

12 Claims, 3 Drawing Sheets

CYLINDRICAL CASE FOR PROPELLANT CHARGE POWDER

This application is related to, and claims the benefit of priority to, German patent application 10 2018 007 834.6, filed Oct. 4, 2018 and to German patent application 10 2018 218 423.2, filed Oct. 29, 2018. The content of both German patent applications is incorporated herein by reference in their entireties.

The invention relates to a combustible, cylindrical case for holding propellant powder with a dimensionally stable jacket wall made of combustible felted fibre material and an insert made of a textile fabric embedded in the jacket wall. Furthermore, the invention relates to a method for manufacturing such a cylindrical case.

Cases have long been known as a component of ammunition for firearms. They are used to hold the propellant powder, which is usually in granular form. Usually cases have a circular-cylindrical and elongated hollow form; the cylinder wall of the case is referred to here as the jacket wall.

Combustible cases burn or consume themselves as a result of firing. If this is done sufficiently residue-free, no case residues need to be removed before the next shot. Ideally, only a metal base attached to the outside of the case should have to be ejected.

It is known to manufacture combustible cases from nitrocellulose and cellulose, usually with additives such as binder resin and stabilizers. To produce them, a screen shape is immersed vertically or horizontally in an aqueous pulp containing nitrocellulose and cellulose. With the help of negative pressure, the screen shape sucks in the fibrous pulp. A wet fleece is formed, usually called "raw felt", which constitutes the pre-stage of the jacket wall. To achieve the final geometry of the jacket wall and for dewatering, the fleece/raw felt is pressed and at least temporarily heated, whereby the case becomes dimensionally stable.

Nevertheless, the case is fragile due to the nature of the combustible material. If it falls to the ground or hits a solid object during handling, cracks may form in the jacket wall or the case may break completely. If the case is filled with propellant powder as intended, this can no longer be tolerated, as escaping propellant powder obviously represents an enormous safety risk.

For this reason, there have long been various proposals to reinforce the case's jacket wall with an embedded insert and thus reduce the fracture vulnerability. For example, it is known from WO 2011/015346 A1 that a coarse-meshed net made of cotton yarn is wrapped in the jacket wall created during the production of the pulp. The multilayer-wrapped net increases the strength of the case to such an extent that crack formation in the jacket wall or even complete destruction of the case by impact or falling is practically impossible. However, the manufacturing process is complex and the thickness of the jacket wall is high, which—with a given outer diameter—makes the usable volume of the case for the absorption of propellant powder smaller than it would be possible without a multi-layer reinforcing insert.

So there is a need for a case that is safe to handle and still only requires a comparatively thin jacket wall.

Therefore, according to the invention, a combustible case to contain propellant powder with the features of claim 1 is proposed. Furthermore, a method of manufacturing a cylindrical case with the features of claim 9 is proposed. Advantageous embodiments are subject of the dependent claims and of the following description.

The invention particularly includes the embedding of an insert, which is stretchable, in the jacket wall of the case.

This is in contrast to the previous tradition of increasing the strength of the shell wall through the insert. With the invention, mechanical damage to the jacket wall is permitted and the insert now has the function of keeping cracks and fracture openings in the jacket wall closed against the leakage of propellant powder, which it is capable of doing due to its elasticity. This allows a small thickness of the jacket wall of the case in two ways. The mechanical strength, which the shell wall has from the outset without considering an insert, can be applied less than before, since cracks and fractures are permissible. And the insert itself can also be comparatively thin, since it does not reinforce the jacket wall, but only retains the bulk powder inside the case.

The stretchability of the insert must be dimensioned in such a way that it can perform this function, i.e. bridging cracks and other fracture openings by expansion, without achieving its ultimate elongation (=maximum stretch). The correct stretch parameters in this sense can be determined empirically, e.g. by standardized drop tests, which have so far been used to test the breaking strength of the known cases. Tests already carried out by the applicant with cases according to an embodiment of the invention have shown that sufficient stretchability of the insert in the longitudinal direction of the case may be more important than extensibility in the circumferential direction in certain applications.

The elasticity of the insert is preferably achieved by forming it as mesh fabric (i.e. knitted fabric in the present context) and very preferably as warp-knitted fabric, a weft-knitted fabric and/or a crocheted fabric. For such inserts, stretchability is the result of yarn guidance.

Since the insert must of course also be combustible, it normally includes cotton yarn. However, cotton yarn itself is not stretchable. If the yarn itself shall also contribute to the elasticity, cotton yarn is completely or partially replaced by a polyurethane-cotton mixed yarn. Such mixed yarn is commercially available. It regularly has a core of polyurethane covered with cotton.

In order to keep the thickness of the sheath wall small, an insert consisting of only one layer of knitted fabric is preferred. It has been shown that the single layer formation is sufficient to safely prevent the escape of bulk powder through fracture splits and other fracture openings in the jacket wall.

Based on empirically gained knowledge, an arrangement of the insert in the middle of the jacket wall, with respect to the wall thickness of the jacket wall is optimal. However, it is also possible to arrange the insert further inside the wall without significantly impairing the retention function. Such an arrangement can be conditioned by manufacturing constraints.

In the embodiment preferred for all shapes of the insert, the insert is configured as an extensible hose whose central axis coincides with the central axis of the case in the embedded state. The hose is preferably manufactured seamlessly. Suitable stretchable hoses are manufactured industrially as mesh fabric, preferably preferably as warp-knitted fabric, weft-knitted fabric and/or crocheted fabric and are commercially available. According to preferable embodiments described with respect to FIG. 3, commercially non-available hoses may be used as insert.

The use of tubular inserts greatly simplifies the manufacture of the cases in accordance with the invention. In the course of the manufacturing process described above, after the raw felt has been built up, the expandable insert hose is expanded to a wall thickness of, for example, the middle of the wall and pulled over the raw felt in the axial direction of the screen. Subsequently, the raw felt is further built up until the final thickness is reached and then, as usual, pressed and hardened by heating.

In order to achieve the thinnest possible radial insert and thus have more space for propellant powder at a given diameter, the insert is designed as a single layer according to an embodiment and can be stretched both axially and radially. In the case of an insert embodiment, the textile fabric must be stretchable on two axes to absorb cracks/breaks etc. in the case and thus allow axial and/or radial (which also means circumferential) expansion.

According to another embodiment, the insert has at least two or three layers, of which a first layer is at least axially stretchable and a second layer is at least radially stretchable. This means that more favourable textile fabrics can be used, each of which only has to be stretchable with respect to one axis.

A radial stretchability of the insert is understood in particular as an stretchability of the insert with respect to a circumferential direction of the insert, in particular if the insert has a hose shape or another hollow shape, in particular cylindrical or partially cylindrical. The correspondence of the two terms results in particular from the application of a hose-shaped insert: if the hose is radially stretched, this stretchability in particular is provided by stretching the insert with respect to its circumferential direction.

Depending on the material used and, if applicable, the processing of the material into a suitable knitted fabric, the insert can be stretched due to the macroscopic elasticity of a material of the insert and/or due to the intermeshing of a knitted fabric of the insert according to different embodiments.

With regard to the choice of material for the insert, tests have shown that the interlining sensibly comprises at least one natural and/or synthetic yarn, in particular a cotton yarn and/or polyurethane and cotton mixed yarn and/or silk yarn and/or polyurethane yarn and/or nylon yarn, in particular at least one such yarn.

According to one embodiment, the insert is arranged, in relation to the thickness of the jacket wall, in its centre or closer to an inner side or an outer side of the jacket wall, wherein particularly an arrangement of the insert is provided between the first quarter and the fourth quarter of the thickness of the jacket wall. Tests carried out by the applicant have shown that, in the event of damage, an arrangement of the insert between the first and second thirds of the thickness of the jacket wall ensures retention of the propellant powder; this is also possible with a central arrangement and with an arrangement between the second and third thirds of the thickness of the jacket wall.

In order to further simplify the manufacturing process, according to an embodiment the insert can also be arranged directly on an inner side of the jacket wall. In this embodiment, the felting of the case on the screen does not have to be interrupted in order to draw up the insert. Rather, the insert is first pulled on and then felting begins. In this manufacturing variant, case material is deposited in particular between the meshes (i.e. stitches in the present context) of the insert, so that the insert is reliably and firmly arranged on the finished case.

In the context of this application, a cylindrical case is also to be understood as a case which, although essential part of its longitudinal extension is circular cylindrical, has a deviating diameter towards its bottom and/or tip, in particular a tapered diameter.

According to an aspect of the invention, a method of manufacturing a cylindrical case is proposed, particularly according to an embodiment of the invention. The method comprises at least the following steps: Immersing a screen shape in an aqueous pulp containing nitrocellulose and cellulose; sucking the pulp onto the screen shape by means of negative pressure so as to form a fleece; drawing a hose-shaped insert onto the screen shape and/or onto the fleece previously formed.

According to one embodiment, the insert is drawn on before the pulp is sucked in or as an intermediate step between two sucking processes or during the sucking in of the pulp.

If the insert is drawn on before the pulp is sucked in, the insert is located on the inside of the jacket wall in the finished case. If the insert is drawn on as an intermediate step between two aspiration processes and/or during the aspiration of the pulp, the selection of a point in time at which the insert is installed can determine the range of the thickness of the jacket wall in which the insert is located in the finished case.

For example, tests can be carried out to determine how long the pulp has to be sucked in before the insert is fitted on the one hand and after the insert has been fitted on the other hand, in order to achieve a radially central arrangement of the insert with respect to the thickness of the jacket wall.

Further advantages and applications of the invention result from the following description in connection with the figures.

Figure 1:
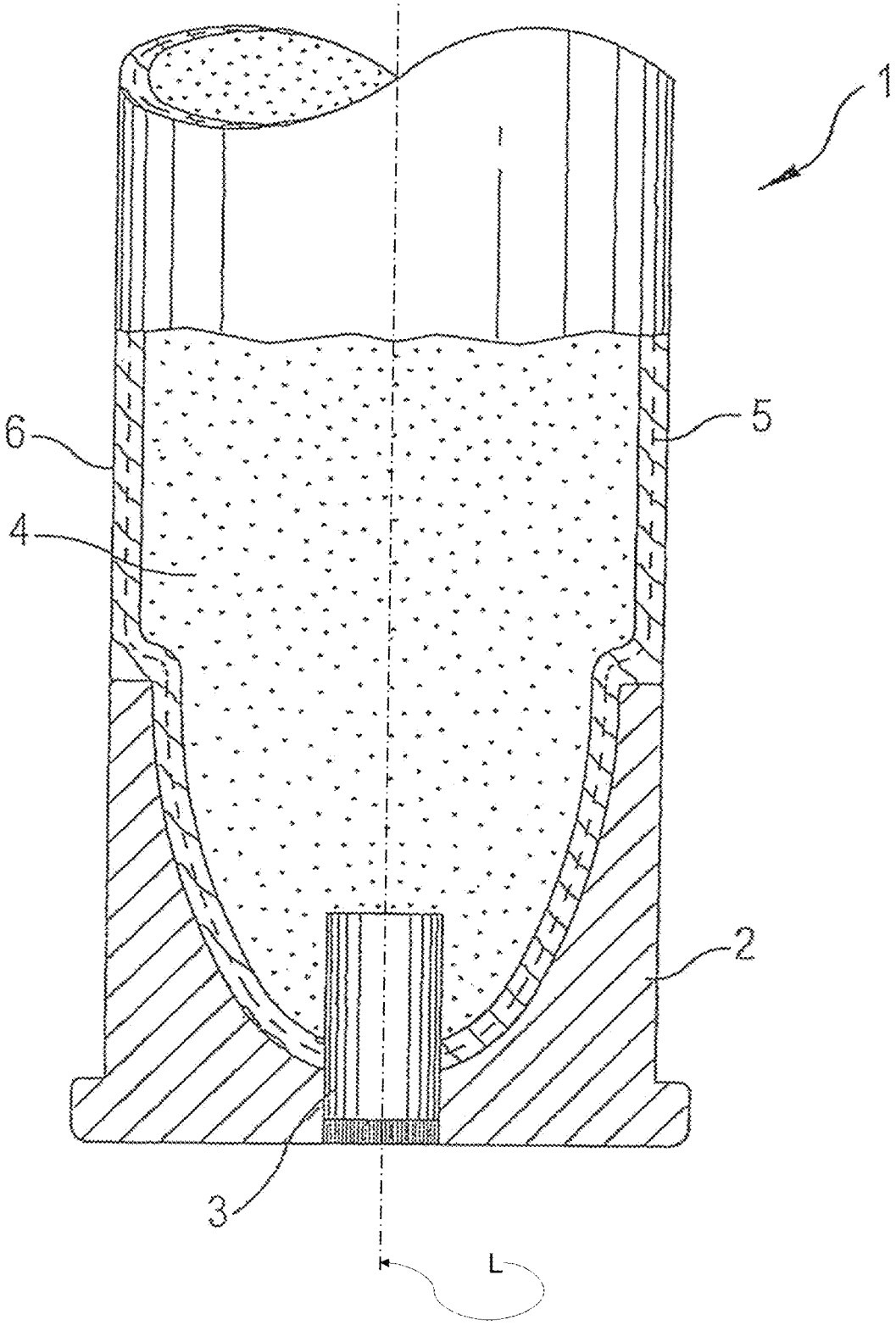
FIG. 1 shows schematically a case according to an exemplary embodiment of the invention as a component of a cartridge.
Figure 2:
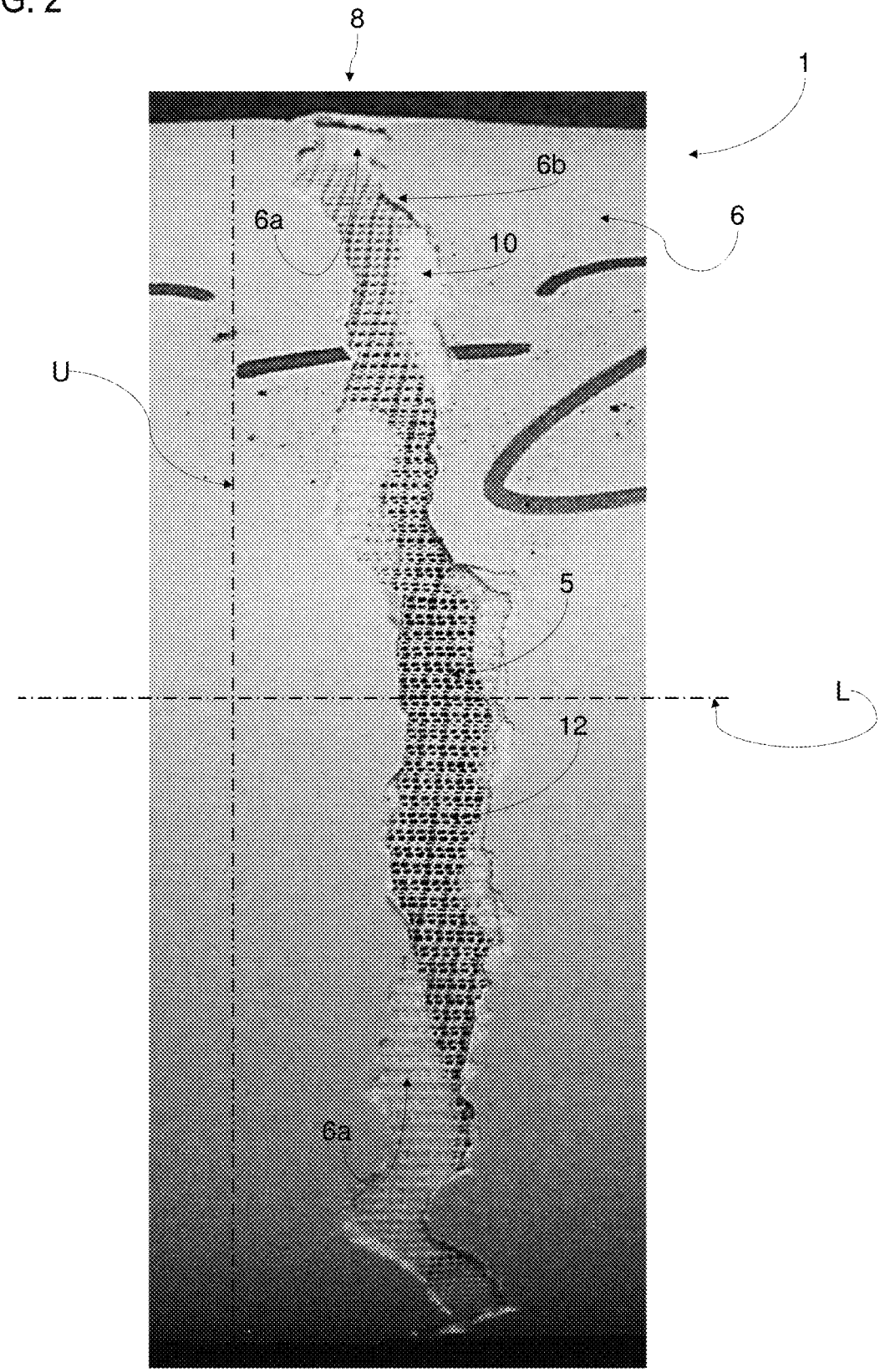
FIG. 2 shows a photo of a case from FIG. 1 after a fracture test with its insert partially exposed at the area of fracture.
Figure 3:
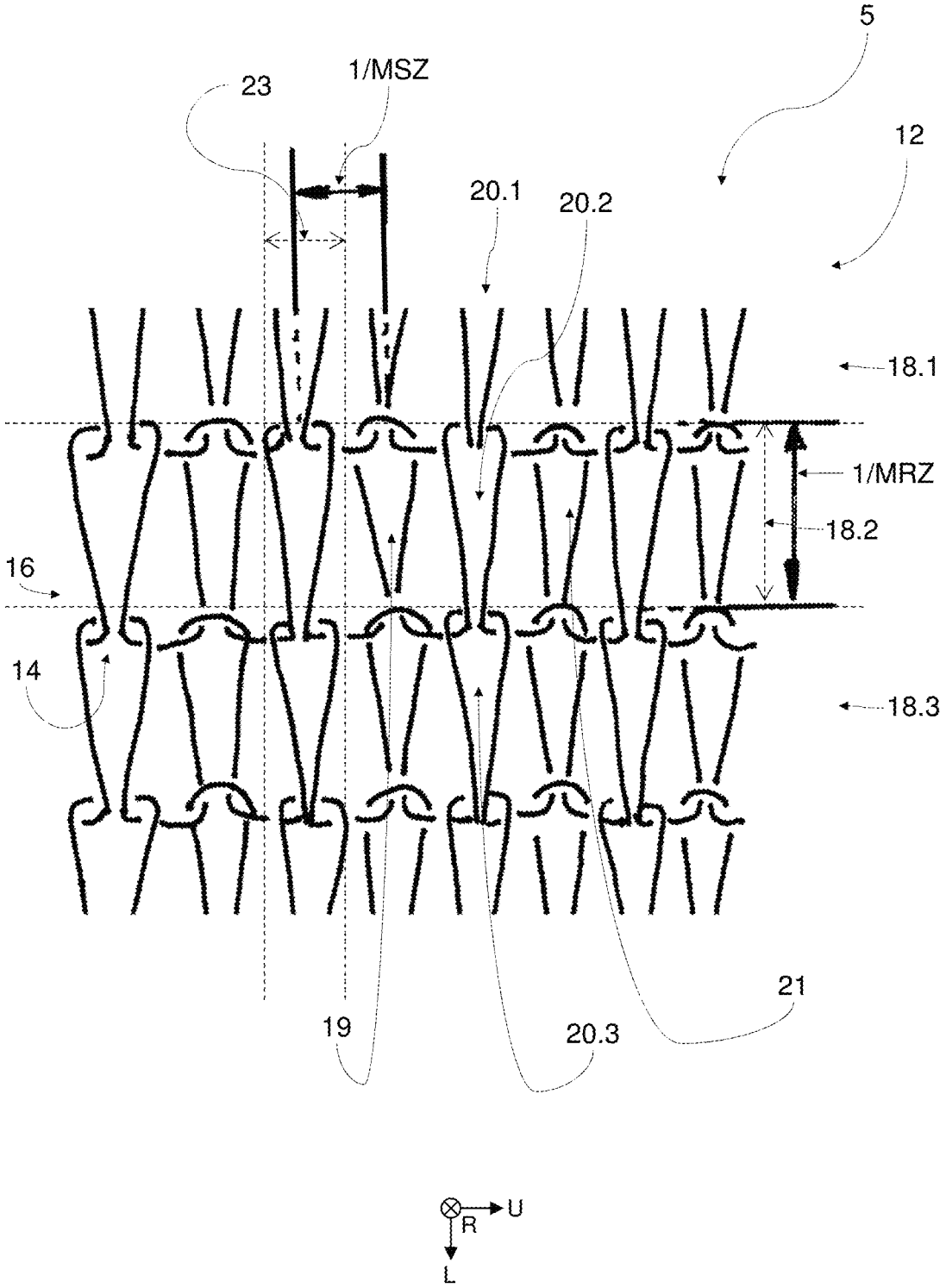

FIG. 3 schematically shows a section of the knitted fabric which forms the insert of the case from FIGS. 1 and 2.

FIG. 1 shows a schematic example of a case 6 as part of a cartridge 1. The case is elongated and circular cylindrical and contains granular propellant powder 4 in its interior. An insert 5 is embedded in the jacket wall of the case 6.

A bottom 2 with a detonator 3 is attached at the lower end of cartridge 1.

The case 6 is made of felted cellulose and nitrocellulose fibres as well as conventional additives. The embedded insert 5 is a stretchable hose made seamlessly from knitted fabric 12, here exemplarily from warp-knitted, crocheted and/or weft-knitted fabric. Due to its embedding in the case 6 as shown, its central axis coincides with the central axis of the case.

The hose is made of 50 percent normal cotton yarn and 50 percent polyurethane-cotton mixed yarn, whereby in experiments a variant with one third cotton yarn and two thirds polyurethane-cotton mixed yarn also turned out to be a good material for the hose. In both cases, the mixed yarn has a polyurethane core coated with cotton. In the exemplary embodiment, the mixed yarn has a composition of 89% cotton and 11% PUR, wherein according to embodiments, a PUR ratio of between 5% and 20% may be considered.

Due to its knitted construction, the hose forming the interlining is highly stretchable. The elasticity in the axial direction of the hose is additionally supported by the polyurethane-cotton mixed yarn.

If the case 6 is damaged by mechanical action so that a crack, a gap or another fracture opening occurs in the jacket wall, the insert is exposed in the fracture opening and stretched there to such an extent that it keeps the fracture opening closed against the granular propellant powder inside the case without tearing.

A typical case according to the invention has an outer diameter of between 50 and 170 mm and a length of between 35 and 75 cm and a, particularly jacket, wall thickness of between 1.5 and 4 mm, in particular 2.5 mm.

FIG. 2 shows a photo of a case 6 from FIG. 1 after a fracture test with an insert 5 partially exposed at a fracture area 8. The arrangement of the insert 5 between a radially inner part 6*a* and a radially outer part 6*b* of the case 6 is clearly visible. A felting 10 formed by the meshes of the insert 5 is also partially visible.

The dark inscription on the outer part 6*b* of case 6 originates from the sample marking of the fracture test performed and is irrelevant here.

FIG. 3 schematically shows a cut-out from the knitted fabric 12, which forms the hose of the insert 5 of the case 6 from FIGS. 1 and 2.

Tests carried out by the applicant have shown that the insert 5 as knitted fabric 12, here exemplarily as warp-knitted, crocheted and/or weft-knitted fabric, provides very high tensile strength and high elongation values with a relatively low weight per area and a low radial dimension of the hose. Such textile surfaces are produced, for example, on circular knitting machines. With a circular knitting machine, for example, a seamless hose insert as shown in the exemplary embodiment can be produced.

In order to enable very high stretching of the insert 5, a certain mesh binding 14 is used in the embodiment example. A mash pattern 16 of the mesh binding 14 is shown in FIG. 3.

The mesh pattern 16 shows an excerpt of a large number of mesh courses 18 arranged one above the other in the vertical direction of the FIG. 3 illustration, and a large number of meshs 20 arranged one next to the other in the transverse direction of the FIG. 3 illustration. In the example, the vertical direction in the representation of FIG. 3 corresponds to a longitudinal direction L of the insert 5 or the case 6; the transverse direction corresponds to the circumferential direction U of the insert 5 or the case 6.

Each mesh 20.2 is guided at its lower end through the corresponding mesh 20.3 of the lower adjacent mesh course 18.3 and guides the corresponding mesh 20.1 of the upper adjacent mesh course 18.1.

The corresponding meshs 20 of adjacent mesh courses 18, form a mesh wale 23 and are each guided on the same radial side of the hose of the insert, i.e. either all on the outside or all on the inside.

Neighbouring meshs 20 of a course 18 are always guided in the opposite radial side; i.e. if one adjacent mesh 20 is guided on the inside, the adjacent meshs 19 and 21 are each guided on the outside, and if one adjacent mesh is guided on the inside, the adjacent meshs are each guided on the inside.

In the exemplary embodiment of the case, between ten and 13 (thirteen) courses of meshes per centimetre of longitudinal extension are provided in the unstretched state of the insert in the mesh, in particular between 11.5 and 12 courses of meshes (mesh courses number MRZ, FIG. 3 shows its inverse value). It is also customary to specify mesh courses per two centimetres: to this extent, the insert has a fabric pattern with between 20 (twenty) and 26 (twenty-six) mesh courses per two centimetres of longitudinal extension, in particular between 23 and 24 mesh courses per two centimetres.

With regard to the mesh wales 23, in the unstretched state of the insert, between ten and a half and 13.5 (thirteen point five) mesh wales per centimetre of circumferential extension are provided in the fabric pattern, in particular between 11.75 and 12.25 mesh wales (mesh wales number MSZ, FIG. 3 shows its inverse value). An indication in "mesh wales per two centimetres" is also customary: to this extent the insert exhibits a fabric pattern with between 21 (twenty-one) and 27 (twenty-seven) mesh wales per two centimetres of circumferential extension, in particular between 23.5 and 24.5 mesh wales per two centimetres.

In a state mounted on the case, the insert of the exemplary embodiment exhibits a fabric elongation (=stretch), in particular in the circumferential direction U (or radial direction R) of the case and/or in the longitudinal direction L of the case, of 5% to 20% in comparison with the unstretched state, in particular of approx. 11%. This elongation state particularly constitutes the elongation state shown in FIG. 2 with respect to the magnitude, if the slight additional elongation due to the displacement at the point of fracture is neglected.

The seamless hose-shaped insert 5 used in the embodiment example shows a maximum elongation of approx. 420% in the transverse direction of the representation of FIG. 3—i.e. in the circumferential direction U of the hose. In the vertical direction of the representation of FIG. 3—i.e. in the longitudinal direction L of the hose—the maximum elongation is approx. 80%. A maximum elongation in the radial direction of the insert 5 hose can be calculated from or with the hose diameter in the unstretched state and the maximum elongation in the circumferential direction U of the hose, taking into account an additional elongation in the longitudinal direction L if necessary.

Cellulosic fibres are suitable for the material of insert 5, for example used in their pure form (100% cellulosic fibres) or in a fibre blend (for example cotton fibres with a synthetic material such as PUR).

The desired felting quality of the case (during the felting process through the insert) is achieved by (skilled-in-the-art) coordination of the fibre thicknesses and the technological parameters of the yarn and knitting method, based on the exemplary embodiment. This means that it is ensured that the fibre mass of the textile gets stuck in the "mesh legs" and thus prevents separation or splitting of the case 6 body.

REFERENCE SIGNS

1 cartridge
2 bottom
3 detonator
4 propellant charge powder
5 insert
6 case
6*a* inner part of the case
6*b* outer part of the case
8 fracture area
10 felting
12 mesh fabric
14 mesh binding
16 mesh pattern
18 mesh course
19, 20, 21 mesh
23 mesh wale
L longitudinal axis/direction
U circumferential direction
R radial direction
MRZ mesh courses number
MSZ mesh wales number

I claim:

1. A cylindrical case (6) for receiving propellant powder (4) with a dimensionally stable jacket wall of combustible, felted fibre material and an insert (5) of a textile fabric in the jacket wall, characterized in that the insert (5) has a greater ultimate elongation than the felted fibre material.

2. The case according to claim 1, in which the insert (5) is of single-layer construction and is expandable both axially and radially.

3. The case according to claim 1, in which the insert (5) has at least two or three layers, of which a first layer is at least axially stretchable and a second layer is at least radially stretchable.

4. The case according to claim 1, in which the insert (5) consists of knitted fabric.

5. The case according to claim 4, wherein the fabric is a warp-knitted fabric.

6. The case according to claim 1, in which the insert (5), with respect to the thickness of the jacket wall, is arranged in the centre of the jacket wall or closer to an inside or an outside of the jacket wall.

7. The case according to claim 6, wherein the insert is between the first quarter and the fourth quarter of the thickness of the jacket wall.

8. The case according to claim 1, in which the insert (5) is arranged on an inside of the jacket wall.

9. The case according to claim 1, in which the insert (5) is in the form of a hose whose central axis coincides with the central axis of the case (6).

10. The case according to claim 9, in which the hose is seamless.

11. A method of manufacturing a cylindrical case (6) according to claim 1, comprising:

immersing a screen shape in an aqueous pulp containing nitrocellulose and cellulose, applying negative pressure to conform the pulp to the screen shape so that a fleece is formed, pulling a tubular insert onto the screen shape and/or onto the flow formed.

12. The method according to claim 11, whereby the insert is drawn on before applying the negative pressure or as an intermediate step between a first application and a second application of negative pressure, or during the application of negative pressure.

* * * * *